US007837346B2

(12) United States Patent
Griffin

(10) Patent No.: US 7,837,346 B2
(45) Date of Patent: Nov. 23, 2010

(54) INTERFACE APPARATUS FOR MOUNTING A PORTABLE ILLUMINATION TOOL AND RELATED ILLUMINATION ASSEMBLY

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 0 days.

(21) Appl. No.: 12/364,160

(22) Filed: Feb. 2, 2009

(65) Prior Publication Data

US 2009/0225557 A1 Sep. 10, 2009

Related U.S. Application Data

(60) Provisional application No. 61/025,637, filed on Feb. 1, 2008.

(51) Int. Cl.
*F21V 21/08* (2006.01)

(52) U.S. Cl. ..... 362/191; 362/190; 362/119; 248/309.1

(58) Field of Classification Search ..... 362/190, 362/191, 208, 119, 120; 248/309.1, 311.2, 248/312.1, 313
See application file for complete search history.

(56) References Cited

U.S. PATENT DOCUMENTS 4,376,965 A 3/1983 Bacevius
5,860,728 A * 1/1999 Maglica ..... 362/191
2003/0021109 A1 1/2003 Matthews et al.
2003/0090894 A1* 5/2003 Cummings ..... 362/110
2004/0045209 A1* 3/2004 Nielsen ..... 42/146
2007/0195521 A1 8/2007 Rosiello

FOREIGN PATENT DOCUMENTS

WO WO 2006050163 A1 5/2006

OTHER PUBLICATIONS

PCT International Search Report, PCT Application No. PCT/US09/32847.
PCT Written Opinion of the International Searching Authority, PCT Application No. PCT/US09/32847.

* cited by examiner

*Primary Examiner*—Laura Tso
(74) *Attorney, Agent, or Firm*—Nawrocki, Rooney & Sivertson, P.A.

(57) ABSTRACT

An illumination tool fixture is generally provided. The fixture comprises an illumination tool receiving sleeve and a clamping assembly operatively received at an end thereof. The sleeve is generally characterized by first and second sleeve segments, each having first and second sleeve ends. The second sleeve end includes an interior circumferential wall segment characterized by a taper, and a thread bearing outer surface segment. Manipulation of a portion of the clamping assembly, namely a clamping ring thereof, establishes a wedged interference engagement for an illumination tool within the fixture.

21 Claims, 6 Drawing Sheets

INTERFACE APPARATUS FOR MOUNTING A PORTABLE ILLUMINATION TOOL AND RELATED ILLUMINATION ASSEMBLY

This is a U.S. national patent application filed under 35 U.S.C. §111(a) claiming priority under 35 U.S.C. §119(e)(1) to U.S. provisional patent appl. Ser. No. 61/025,637, filed Feb. 1, 2008, said application incorporated herein by reference in its entirety.

TECHNICAL FIELD

The present invention generally relates to illumination devices or tools, more particularly, to an interface apparatus for receipt and retainment of a personal portable illumination tool in furtherance of mounting same to a support structure or mount, as well as illumination assemblies for supported mounting.

BACKGROUND OF THE INVENTION

Very few tasks can be satisfactorily accomplished by people in darkness. For the most part, it is essential to see what we are doing, and our ability to see is proportional to the amount of available light. To supplement insufficient available light, people often use portable illumination tools or devices. Illumination tools or devices, e.g., flashlights, are readily available and virtually universal in application. While styles of these lights vary widely, with specialized structures for select applications, their capabilities are divisible into definable categories that are well known to those within the illumination tools community, see for example the products of SureFire® LLC, California, USA, "2004 Illumination Tools."

Two categories of lights are personal or hand-carried (i.e., hand), and surface-mounted (i.e., surface). Hand lights generally, do not have, as a functional element, the ability to be attached/secured to anything, save for a pocket, vis-a-vis a clip, as exemplified by U.S. Pat. No. 6,547,415 (Matthews), or a belt, vis-a-vis a holster or scabbard, as exemplified by U.S. Pat. No. 5,593,074 (Matthews). Hand lights have elements and features that make them most functional while being held in the hand, either "in carry" or "in use."

Surface lights, typically characterized by a fixture having an integral lamp, are designed to achieve their functionality (i.e., are optimally functional) when attached to a specific object, the functionality being achieved by means of the provision and arrangement of components to accomplish the specific object attachment. For example, in the context of target illumination devices, a lamp is integrally provided as part of a fixture, e.g., a housing or module, for attachment to a weapon, more particularly, to a weapon rail, see e.g., U.S. Pat. No. 5,685,105 (Teetzel) and U.S. Pat. No. 6,609,810 (Kim), the Bright Light Aiming System Tactical (BLAST) 2 from Laser Devices, Inc., California USA, and/or dedicated forend weaponlights from SureFire. Fixtures for target illumination devices also contemplate vertical foregrips equipped with lamp assemblies, see e.g., those of SureFire.

Heretofore known attempts to attain the aforementioned hybrid functionality for an illumination tool appear limited, known devices suffering a variety of limitations, several among them being a lack of versatility, and a lack of, or at least less than desirable, environmental or use integrity (e.g., device/assembly adjustment, repair and maintenance due to a less than desirable interface between the tool and the surface to which it is attached). For example, U.S. Pat. No. 6,712,485 (Matthews), which is a continuation of Matthews '415 previously noted, discloses a bolt/C-clamp combination wherein the clamp is secured about a tube, a head of the bolt being received in an undercut groove intermediate of a flashlight housing; and, U.S. patent application Pub. No. US2003/0202345 (Kim) which discloses ring forming elements securable about a switch end of a flashlight, one of the ring forming elements including a clamping element (e.g., Weaver style) for attachment to a rail structure of a firearm.

While it is critical that the interface between the personal illumination tool and the fixture within which it is to be received is secure and unwavering, heretofore known assemblies or fixtures have required tools to accomplish securing or integrating the illumination tool to/with the fixture, see e.g., U.S. Pat. No. 5,560,703 (Capps, III) and U.S. Pat. No. 6,023,875 (Fell et al.). While the use of tools for securing the illumination tool with respect to the fixture is less than desirable, the absence of a secure, reliable mechanical interface for the illumination tool, see e.g., U.S. Pat. No. 6,851,214 (Oz), is likewise to be avoided as less than advantageous.

Prior efforts, namely those of Applicant/assignee RM Equipment, Inc. of Miami Fla., are known and documented. For instance, in connection with a weapon grip assembly, an interface structure (e.g., a flashlight assembly) is depicted and described in Applicant's published international application WO 2005/017439 A2 (see e.g., FIGS. 11 & 12), the underlaying application thereof, i.e., PCT US2003/035601, being incorporated herein by reference in its entirety. Improvements in the aforementioned approach are likewise known and documented.

In Applicant's published international application WO 2006/050163 Al, the underlaying application thereof, i.e., PCT US2005/039079, filed Oct. 31, 2005 and incorporated herein by reference in its entirety, there is shown and described an interface apparatus having an enhanced form and function. Two representative depictions of that illumination assembly (i.e., FIGS. 5 & 2) are provided herewith as FIGS. 1 & 2 respectively. In short, and with reference to those figures, an internal surface ring 26 of sleeve 16 of mounting apparatus 12 is bound between portions of illumination tool 14 (FIG. 2), namely end cap 84 and shoulder 90 of tool body 80 (i.e., upon assembly or reintegration of the illumination tool components within the sleeve, ring 26 is "caught" within a gap delimited by the aforementioned cap and shoulder and which is otherwise intended to receive a band of a lanyard system, see e.g., FIG. 3 reference character 120).

In light of the foregoing, there thus remains a need to provide an apparatus and/or assembly which incorporates or combines the aforementioned functionalities, namely, those of the hand and surface lights. Furthermore, and advantageously, such device and/or assembly should provide for a simple, no-tool mechanical interface. Moreover, an advantageous illumination assembly should minimize, or preferably eliminate a need to disintegrate the illumination tool, more particularly, disintegrate and reintegrate the illumination tool so as to be integrally formed with a portion of the illumination assembly. Further yet, such apparatus, and assembly incorporating same, should provide for heretofore unseen versatility, more particularly, a modularity such that an illumination tool, directly or indirectly, might be quickly secured to a variety of select surfaces vis-a-vis a variety of mounting means or fixtures, and still further, such device/assembly should confidently retain the tool in all regards so as to, for example, prevent misalignment of same, and associated misdirection of the light beam so generated, or generally undermine the integrity of either the tool, the device/assembly, or the surface supporting same.

SUMMARY OF THE INVENTION

An illumination tool fixture for combination with an article of manufacture so as to thereby provide an illumination functionality therefor is provided. The fixture includes an illumination tool receiving sleeve and a clamping assembly. The sleeve is characterized by first and second sleeve segments, each having first and second opposing sleeve ends. The second sleeve end includes an interior circumferential wall segment characterized by a taper, and a thread bearing outer surface segment. The clamping assembly is operatively united with the second sleeve end such that manipulation of a portion of the assembly establishes a wedged interference engagement for an illumination tool received within the fixture.

With regard to an illumination assembly, namely, an operative combination of an illumination tool with the fixture contemplated, such assembly allows the user to attach and detach the illumination tool from the fixture quickly, and at-will. No tools, modifications or manipulation of the illumination tool are required, thereby permitting dual-functionality, namely, that of hand-held operation or surface-held operation.

A contemplated illumination assembly preferably includes an illumination tool and mounting apparatus (e.g., a fixture), namely, a sleeve having a tapering interior surface at a free end thereof characterized by a threaded exterior portion, and a clamping assembly, characterized by a clamp ring supporting a collet, for operative engagement with and advancement upon the threads of the free end of the sleeve. With the illumination tool received within a lumen of the mounting apparatus, tensioning of the collet, via an increasing threading engagement of the clamp ring upon the sleeve threads, wedgingly advances the collet for an interference fit between a body portion of the tool and the tapering interior surface of the sleeve.

It should be appreciated that the subject assembly is easily user modified (i.e., adapted) for attachment (i.e., reversible securement) to a variety of surfaces by substituting or modifying the mounting means/components thereof. For example, and without limitation, the apparatus, or assembly as the case may be, is readily directly supportable by a weapon or assembly/subassembly, or indirectly supported, via a coupling, to a rail coupling fixture for a firearm, a pivotably indexable fixture for a hard hat or the like, and/or a magnetic or magnetized fixture. The subject invention, in all its embodiments, is an improvement in form and function from the interface structure previously disclosed by Applicant in the prior cited documents.

The resulting versatility of the subject invention greatly enhances utility, functionality, and life-cycle of an illumination tool integrally received by the interface apparatus of the subject assembly, and of the tool and subject assembly, and/or components thereof, individually. More specific features and advantages obtained in view of those features will become apparent with reference to the drawing figures and DETAILED DESCRIPTION OF THE INVENTION.

DETAILED DESCRIPTION OF THE INVENTION & DRAWINGS

Figure 3:
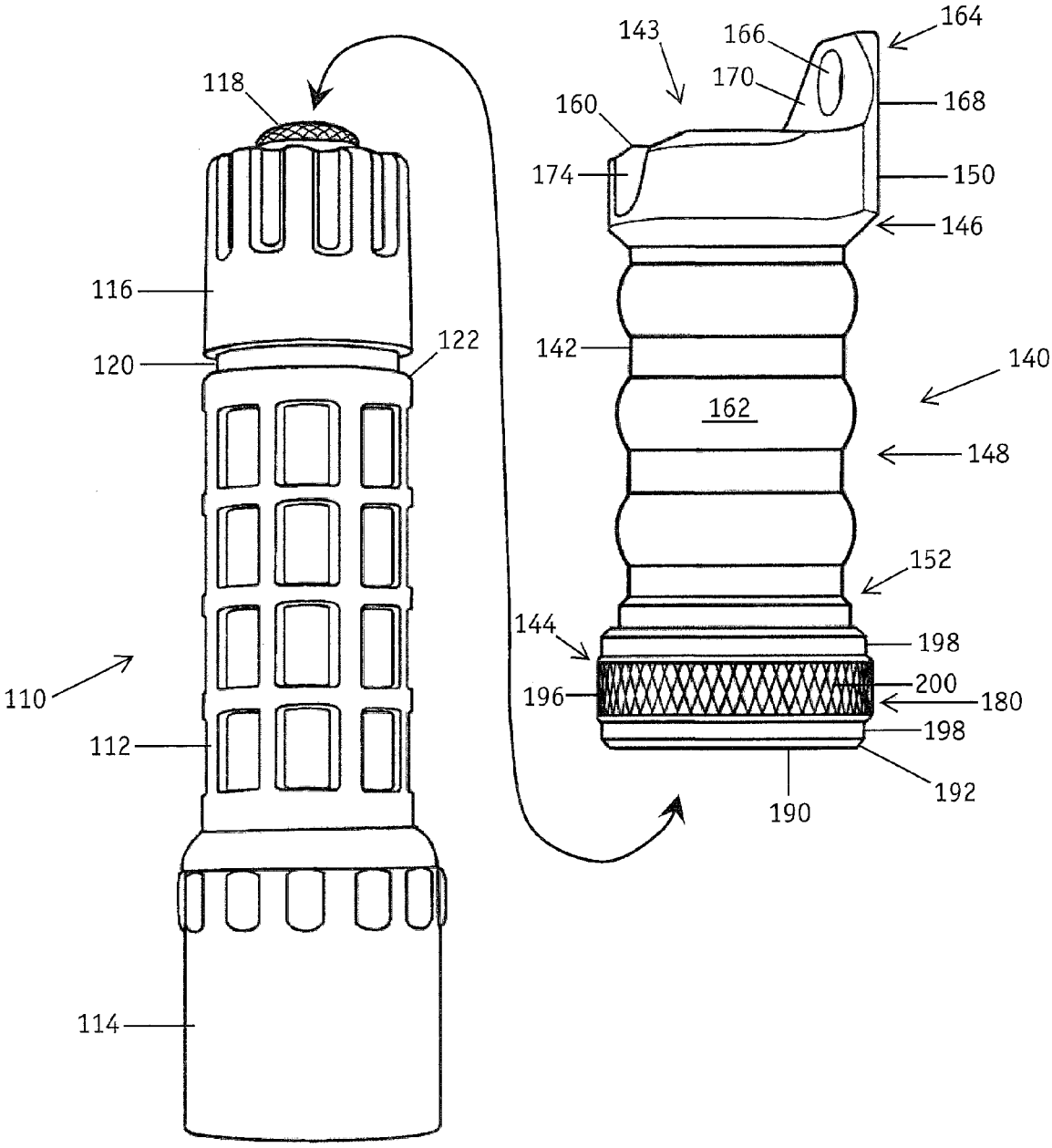
FIG. 3 depicts components of an illumination assembly of the subject invention, namely, an illumination tool and an illumination tool fixture.
Figure 4:
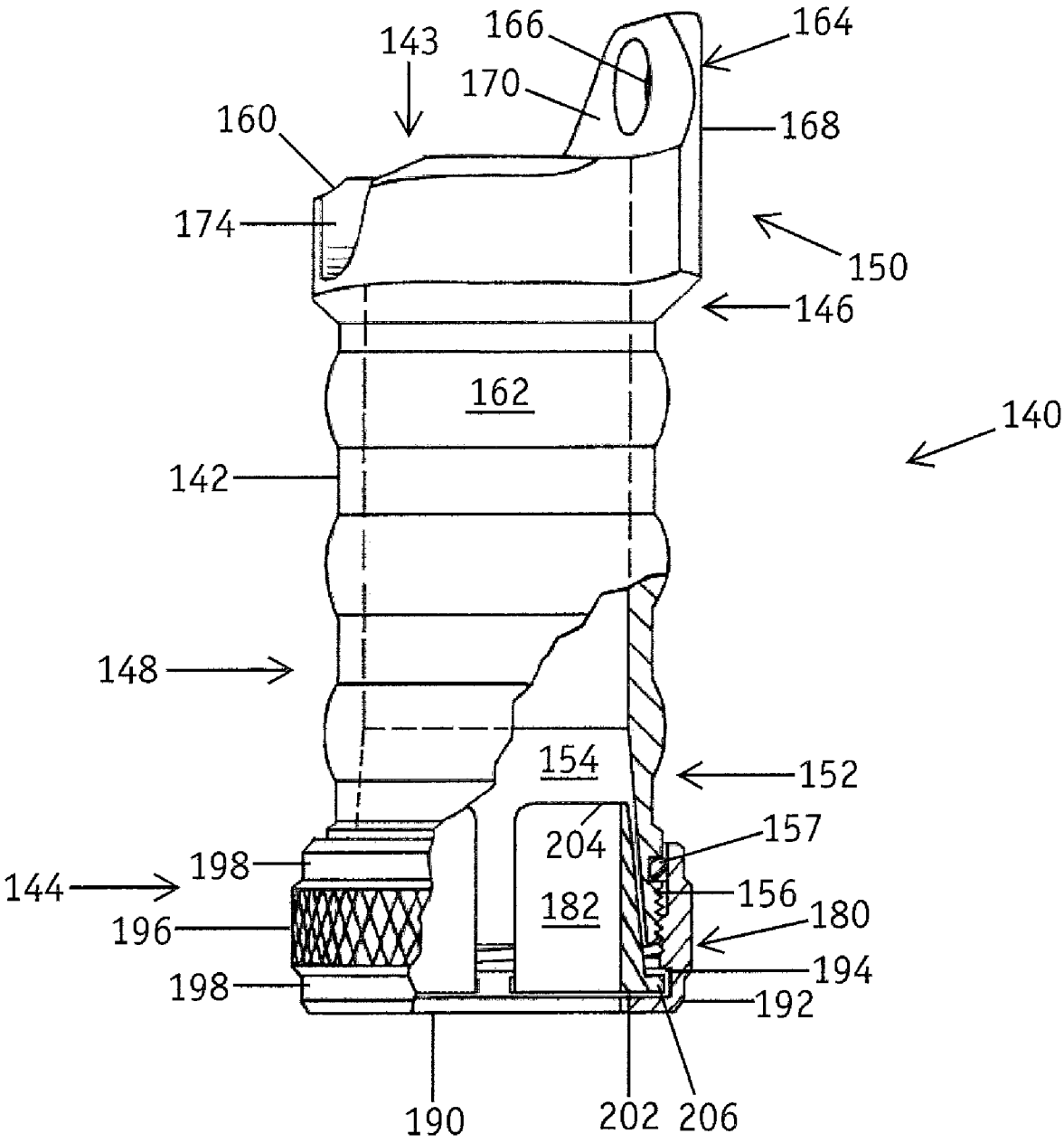
FIG. 4 depicts the illumination tool fixture of FIG. 1, a portion thereof shown in fragment to reveal fixture particulars.
Figure 5:
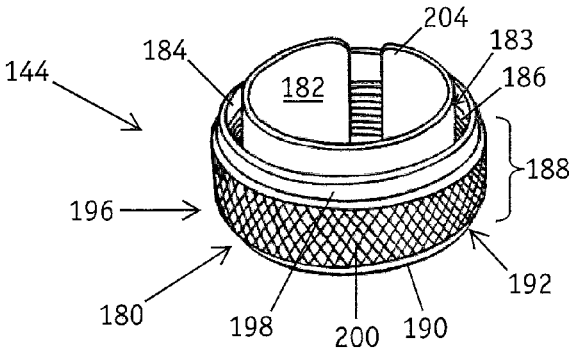
FIG. 5 depicts the clamping assembly of the illumination tool fixture of FIG. 3.
Figure 6:
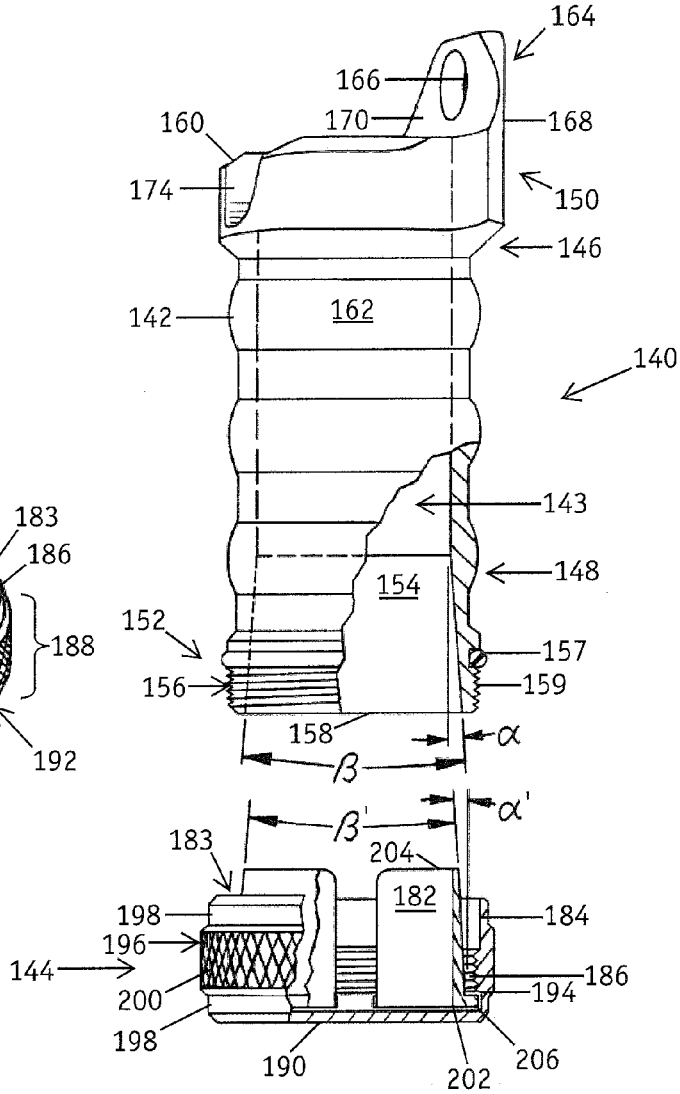
FIG. 6 depicts relationships for and/or between components of the illumination tool fixture of FIG. 3.
Figure 7:
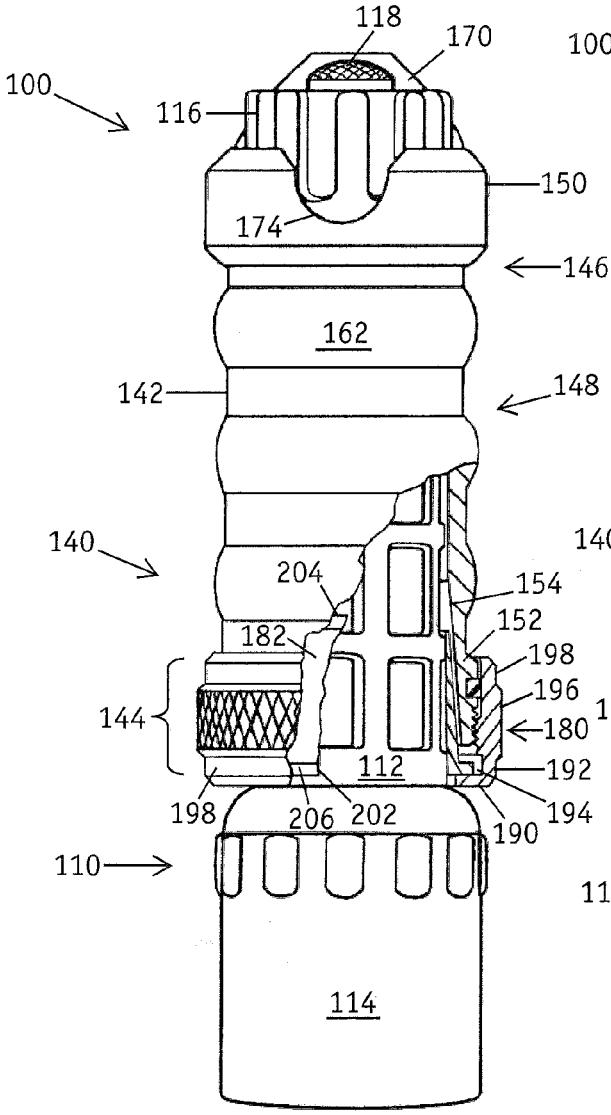
FIG. 7 depicts the components of FIG. 3 in an initial state of integration; and, FIG. 8 depicts the components of FIG. 7 in a subsequent state of integration.
Figure 8:
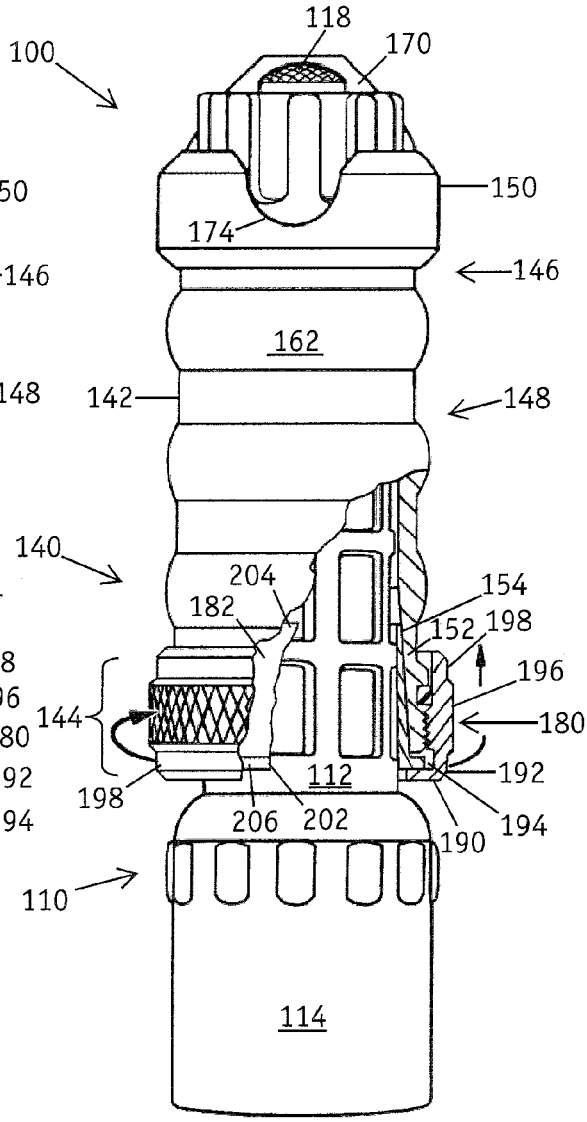

The following description proceeds with general reference to FIGS. 3-8. FIG. 3 generally depicts components of an illumination assembly of the subject invention, namely, an illumination tool and an illumination tool fixture. FIGS. 4-6 illustrate particulars of the illumination tool fixture of FIG. 3, and FIGS. 7 & 8 depict combinations of the assembly components of FIG. 3. In advance of the subject detailed description of the invention and the drawings, several preliminary matters are noted.

First, in connection to the illumination assembly of the subject invention, more particularly, with regard to an illumination tool, an illustrative, non-limiting "unaltered" personal illumination tool or device is depicted, namely a SureFire® G2 personal light, the details of which are generally commercially well-known, and which are also to some degree generally presented in connection with the disclosure of the aforementioned Kim publication (i.e., Pub. No. US2003/0202345). Further representative manufacturers of such tools include, but are not limited to, Longbow Gear Pte Ltd., Stream Light, Inc., and Laser Devices, Inc.

Figure 1:
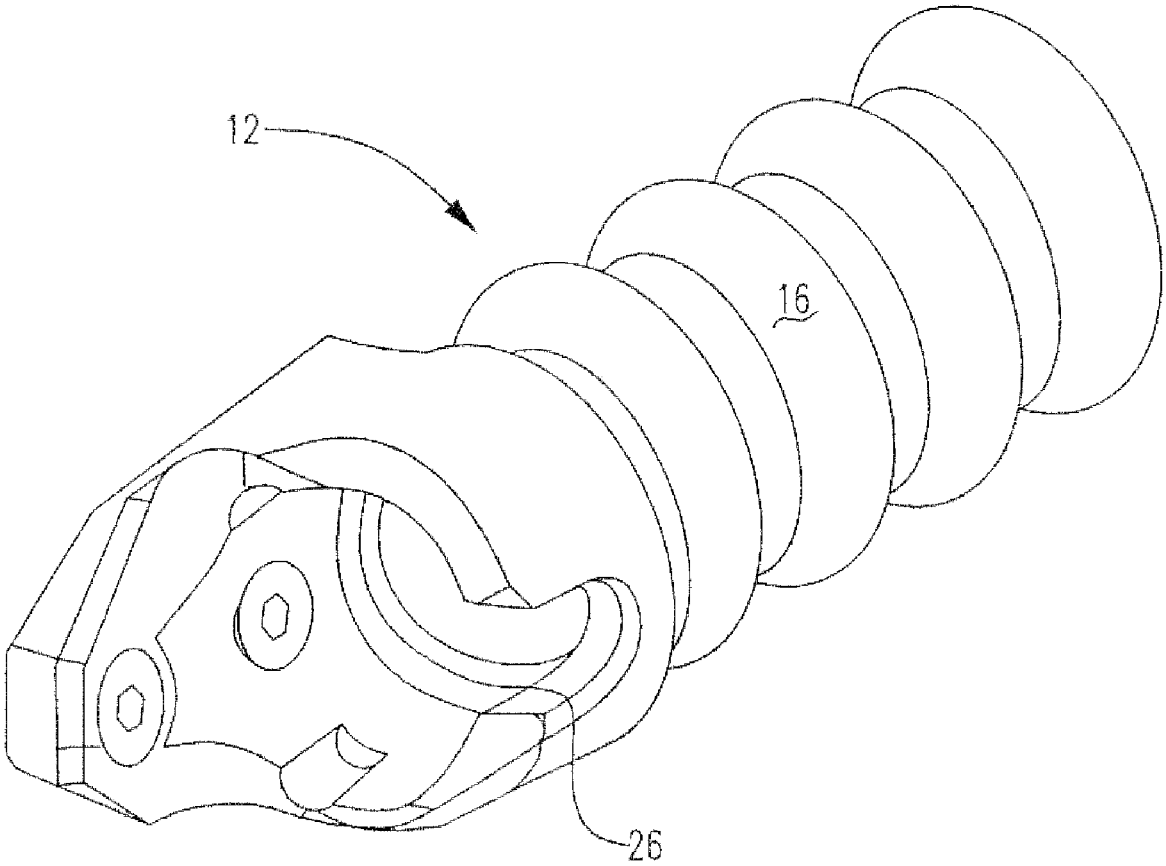
FIG. 1 Prior Art
FIG. 1 depicts select particulars of a representative, non-limiting embodiment of Applicant's interface apparatus of WIPO publication WO 2006/050163 A1.

Second, while the interface or mounting apparatus of the subject invention is perhaps best shown in FIG. 6, and the illumination assembly of the subject invention is perhaps best shown in FIG. 7 or 8, no explicit environmental context is depicted. Be that as it may, it is to be understood throughout the balance of this description that the interface apparatus/illumination assembly has many advantageous uses, enabled directly or via readily know/appreciated adaptation. As is readily appreciated with reference to Applicant's '163 WIPO publication, for example and without limitation, the apparatus is readily directly supportable by a weapon or assembly/subassembly thereof (FIG. 1); or indirectly supported, via a coupling, to a rail coupling fixture for a firearm (FIG. 8), a pivotably indexable fixture for a hard hat or the like (FIG. 10), and/or a magnetic or magnetized fixture (FIG. 11).

With initial reference now to FIG. 7 or 8, and FIG. 3 the illumination assembly of the subject invention, and the primary elements thereof, are respectively shown. More particularly, illumination assembly 100 generally includes a personal or portable illumination tool 110, and an interface apparatus, more particularly, illumination tool fixture 140 characterized by a tool receiving structure generally fashioned as a tubular member, e.g., illumination tool receiving sleeve 142, and a clamping assembly 144 operatively linked to/with an end thereof.

Generally, suitable illumination tools for receipt by the fixture of the instant invention are characterized by a lamp assembly, more particularly, a lamp housing, a tool body, and commonly, but not necessarily, an end cap, oftentimes an end cap characterized by a lamp actuator. For the sake of illustration, and with particular reference to FIG. 3, illumination tool 110 generally includes a body 112, e.g., battery housing, extending between a head 114, within which is housed a lamp assembly (not shown), and an end cap, more particularly, a removable end cap 116. The end cap 116, within which is housed a switch or switch assembly having an actuator 118, is reversibly received at an end of body 112 of tool 110 to permit access to batteries (not shown) housed therein. The end cap 116 is commonly threadingly received upon a threaded, reduced diameter end portion of the tool body 112. With proper integration of the end cap 116 with the body 112 of the tool 110, a gap 120 intentionally remains between the end cap 116 and a shoulder 122 of the body 112, the gap 120 generally intended to receive a band of a lanyard system.

With general reference now to FIGS. 3-6 illumination tool receiving sleeve 142 of illumination tool fixture 140 may be fairly characterized as having first 146 and second 148 sleeve segments, and first 150 and second 150 opposing sleeve ends, the first sleeve segment 146 including the first sleeve end 150, and the second sleeve segment 148 including the second sleeve end 152. First sleeve end or end portion 150 is advantageously adapted for cooperative engagement, e.g., affixation, to/with a structure or support, i.e., a "mount." Second sleeve end 152, as is readily observed with reference to FIG. 6 and as will be later detailed in connection to/with the clamping assembly 144 of the subject illumination tool fixture, advantageously includes an interior circumferential wall segment 154 characterized by a taper, namely taper $\beta$ characterized by taper angle $\alpha$, and a thread bearing outer surface segment 156 equipped with an o-ring 157 or the like circumscribing same adjacent threads 159 thereof.

Each end of the end portions 150, 152 of the sleeve 142 general terminates in a rim, rim 158 of the free end 152 being preferably but not necessarily planar, whereas the rim 160 of the first end portion 150 is advantageously, but not necessarily non-planar (FIG. 6). As should be appreciated, the notions of first and second are used throughout the subject description to facilitate presentation and discussion of relationships and interrelationships between structures/features of the subject mounting apparatus. Adaptation of the sleeve for affixation to a mount is not exclusively limited to the first end, or second end portion, intermediate adaptation, i.e., at a location along the sleeve intermediate the end portions, is likewise contemplated.

Preferably, but not necessarily, the sleeve 142, more particularly, the second sleeve segment 148 thereof, includes a profiled exterior surface 162; has a cross-section commensurate with that of the illumination tool, i.e., a cross sectional configuration which permits ingress/egress of at least a portion of the illumination tool; and, is advantageously substantially coextensive with the tool body (see e.g., FIG. 7). In furtherance of providing a sheathing functionality, i.e., protection of the illumination tool and maintenance of a secure and stable supported condition, the fixture is advantageously rigid, preferably, but not necessarily, fabricated from a light weight, high strength material such as aluminum. Such arrangement provides supreme protection for the tool of the illumination assembly which ensures proper secure configurational alignment (i.e., the assembly in relation to the mount), thereby greatly minimizing light beam misdirection, as is the case with insubstantial surface area interfaces previously noted, i.e., Matthews '485 and the Kim '345 publication.

Figure 2:
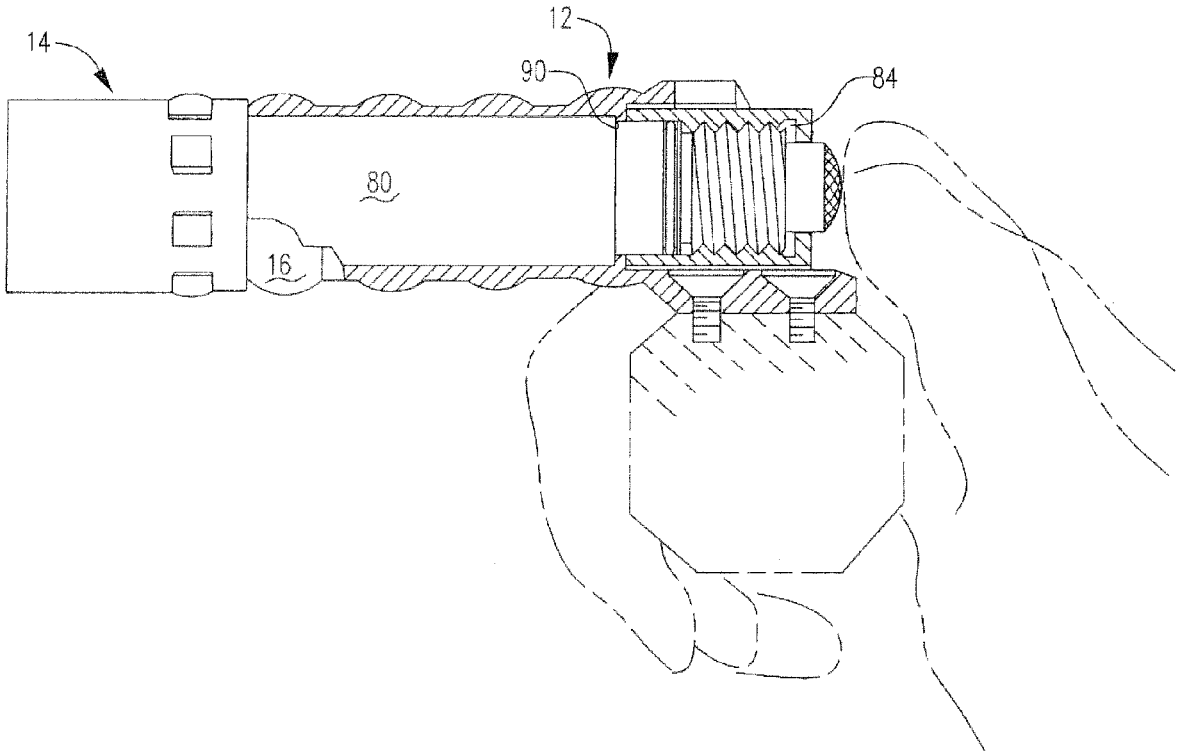
FIG. 2 Prior Art
FIG. 2 depicts select particulars of a mounted representative, non-limiting embodiment of Applicant's interface illumination assembly of WIPO publication WO 2006/050163 A1.

The first sleeve segment 146 of the mounting apparatus 140 generally includes a mount platform 164 for receipt upon or at a portion of a support structure, i.e., a mount, having at least a single aperture 160 therethrough for receipt of a fastener or the like, and a mount contact surface 168, preferably but not necessarily, a substantially flat mount contact surface. As perhaps best seen in FIG. 3, the mount platform 164 may simply be an adapted portion of a sidewall of the first sleeve segment 146, for example, a portion of rim 160 may be readily configured or stylized as a tab or ear 170 as shown. Preferably, the first sleeve segment 146, more particularly, the mount platform 164, includes a spaced apart pair of apertures, one of which is located in the tab 170 thereof. Such configuration greatly facilitates access to mounting fasteners (see e.g., FIGS. 1 & 2), and therefore anchoring of the apparatus to the mount.

As previously noted, each of the opposing end portions 150, 152 of sleeve 140 includes a rim. Rim 160 of the first sleeve segment 146 advantageously includes a notched portion, a notch 174 thereof substantially registering with aperture 166 of the paired apertures of the mount platform 164. Functionally, the notch 174 facilitates access to a head of a mounting fastener, and further permits access to a portion of the illumination tool residing within the first sleeve segment.

With continued general reference to FIGS. 3-6, and particular reference to FIGS. 5 & 6, the clamping assembly 144 generally includes a clamp ring 180 and a tapered sleeve interior thereof, i.e., an interior cylinder or cylindrical segment, a collet, more particularly, collet 182 characterized by taper $\beta'$ and taper angle $\alpha'$ as shown. An annulus, more particularly, a sleeve free end 152/rim 158 receiving annulus 183 is delimited by the clamp ring 180 and the collet 182.

Clamp ring 180, as shown, includes an interior surface 184 bearing threads 186 which mate with threads 157 of the free end 152 of the sleeve 142, and advantageously, but not necessarily, an exterior surface 188 adapted to enhance engagement, more particularly, rotational engagement, in furtherance of advancing the clamping assembly upon the threaded free end of the sleeve. Adjacent a periphery of the clamp ring (i.e., rim 190 of the free end 192 thereof), a groove 194 circumscribes the interior surface thereof. As will be subsequently detailed, the groove permits integration of the collet relative to the ring.

The exterior surface 188 of the clamp ring 180 includes, as shown but not necessarily, primary 196 and secondary 198 surfaces. The primary surface 196, intermediate the opposing peripheries, preferably, but not necessarily, includes a textured surface, e.g., diamond cut pattern 200 as shown. While recalling that one objective of the instant illumination tool fixture is to quickly and securely receive a hand held illumination tool and thereby define a fixture readily receivable by a variety of bases, articles, objects, etc., it should be readily appreciated that the clamp ring is to be reliably bound to the sleeve without resort to tools or any application aid. As such, well known adaptations to aid finger gripping and/or hand tightening are contemplated, and may include a ring characterized by an exterior surface having one or more flats, or more generally, an irregular surface portion or segment.

Collet 182, as shown, is advantageously but not necessarily configured as a cylindrical segment, i.e., a cylinder with a discontinuous sidewall, such configuration providing, among other things, a resiliency or flexibility for the structure. The collet includes a lipped rim 202, and a tapered rim 204 opposite thereof. A lip 206 of lipped rim 202 is received and retained within groove 194 of the interior surface 184 of the clamp ring 180 so as to thereby unite the collet 182 with the clamp ring 180.

Advantageously, but not necessarily, collet 182 extends as shown, namely, beyond the extent of the clamp ring 180 (i.e., the collet sidewall is of a greater "height" dimension (FIG. 5 or 6) than that of the clamp ring sidewall; tapered rim 204 of the collet 182 extends beyond the rim of the clamp ring 180 opposite the free end rim 190 thereof). Moreover, as shown in connection to FIG. 6, while the interior diameter of the collet is uniform throughout it's "height," the exterior diameter thereof is advantageously decreasing in a direction away from lipped rim 202 (i.e., toward to tapered rim 204), resulting in a sidewall of reduced thickness.

With reference now to FIGS. 7 & 8, the tapers of the sleeve and the collet of the clamping assembly are shown working in unison. With receipt of the illumination tool 110 within lumen 143 of the sleeve 142 of the fixture 140 as contemplated with respect to FIG. 3, the general arrangement of FIG. 7 results. As clamping ring 180 is increasingly received upon the threaded free end 156 of sleeve 142 and further over o-ring 157 (FIG. 8), the tool extending through the sleeve lumen is wedgingly retained via the progressive cooperative interference fit between the tapered portions of the primary elements of the fixture. As clamp ring 180 is advanced, collet 182 so to is advanced, more particularly, wedgingly advanced so as define an interference fit between a portion of body 112 of illumination tool 110 and interior 154 of second sleeve end 152.

As should be readily appreciated from the foregoing description, the subject apparatus and assembly adds a "surface" or mounted light functionality to a personal/portable illumination tool via a simple interface structure. An advantageous "universal" illumination tool fixture is provided, more particularly, a fixture that easily, quickly and reliably receives and retains a variety of illumination tools, independent of lamp housing stylings and the like, without the use of tools. The apparatus is readily attached to a select surface or mount by a select fixture, as evidenced by the non-limiting examples cited earlier.

In the outlined approach, the operator quickly and reliably transforms their hand illumination tool into a surface mounted light, and has added new utility to the existing light. The process is easy to reverse, and converts the tool back to its original state or condition, and thus, alternate utility. The operator can optionally change attachment components (e.g., the mount or mount fixture) for the mounting apparatus, allowing heretofore unseen versatility.

Be that as it may, there are nonetheless other variations of the subject invention, some of which will become obvious to those skilled in the art. It is to be understood that this disclosure, in many respects, is only illustrative. Changes may be made in details, particularly in matters of shape, size, material, and arrangement of parts, as the case may be, without exceeding the scope of the invention. Accordingly, the scope of the subject invention is as defined in the language of the appended claims.

That which is claimed is:

1. An illumination tool fixture for combination with an article of manufacture so as to thereby provide an illumination functionality therefor, the fixture comprising:

a. an illumination tool receiving sleeve characterized by first and second sleeve segments, and first and second opposing sleeve ends, said first sleeve segment including said first sleeve end, said second sleeve segment including said second sleeve end, said second sleeve end including an interior circumferential wall segment characterized by a taper, and a thread bearing outer surface segment; and, b. a clamping assembly, characterized by an annulus delimited by a clamp ring and a tapered sleeve interior thereof, operatively linked with said second sleeve end such that manipulation of a portion of said clamping assembly establishes a wedged interference engagement for an illumination tool within the fixture.

2. An illumination tool fixture for combination with an article of manufacture so as to thereby provide an illumination functionality therefor, the fixture comprising:

a. an illumination tool receiving sleeve characterized by first and second sleeve segments, and first and second opposing sleeve ends, said first sleeve segment including said first sleeve end, said second sleeve segment including said second sleeve end, said second sleeve end including an interior circumferential wall segment characterized by a taper, and a thread bearing outer surface segment; and, b. a clamping assembly, operatively linked with said second sleeve end such that manipulation of a portion of said clamping assembly establishes a wedged interference engagement for an illumination tool within the fixture, said clamping assembly comprising an annulus for receipt of said second sleeve end.

3. The illumination tool fixture of claim 2 wherein said annulus is delimited by a clamp ring and a tapered sleeve interior thereof.

4. The illumination tool fixture of claim 3 wherein said clamp ring is adapted for reversible integration with said thread bearing outer surface segment of said second sleeve segment.

5. The illumination tool fixture of claim 3 wherein said clamp ring includes an exterior surface having a textured portion.

6. The illumination tool fixture of claim 3 wherein said clamp ring includes an interior surface characterized by a circumferential groove.

7. The illumination tool fixture of claim 3 wherein said clamp ring includes an interior surface characterized by a circumferential groove which operatively supports said tapered sleeve.

8. The illumination tool fixture of claim 3 wherein said tapered sleeve includes a cut-out in a circumferential wall thereof.

9. The illumination tool fixture of claim 3 wherein said tapered sleeve includes a periphery characterized by an outwardly extending rim.

10. The illumination tool fixture of claim 3 wherein said tapered sleeve includes an outwardly extending rim which is operatively united with said clamp ring.

11. The illumination tool fixture of claim 3 wherein said tapered sleeve is progressively received within said interior circumferential wall segment of said second sleeve segment.

12. The illumination tool fixture of claim 3 further comprising an o-ring interposed between said clamping assembly and said second sleeve end.

13. An illumination tool fixture comprising:

a. an illumination tool receiving sleeve characterized by opposing free ends and first and second sleeve segments, said first sleeve segment including a first free end of said opposing free ends of said illumination tool receiving sleeve, said second sleeve segment including a second free end of said opposing free ends of said illumination tool receiving sleeve, said second free end including an interior circumferential wall segment characterized by a taper, and a thread bearing outer surface segment; and, b. a clamping assembly operatively linked with said second free end of said opposing free ends of said illumination tool receiving sleeve such that manipulation of a portion of said clamping assembly establishes a wedged interference engagement between an illumination tool within the fixture and said interior circumferential wall segment characterized by a taper.

14. The illumination tool fixture of claim 13 wherein said first free sleeve end is adapted to facilitate union of the fixture with an article of manufacture.

15. The illumination tool fixture of claim 13 wherein said first free sleeve end includes a mounting platform.

16. The illumination tool fixture of claim 15 wherein said mounting platform includes an aperture.

17. The illumination tool fixture of claim 13 wherein said second sleeve segment includes a profiled exterior surface.

18. In operative combination, illumination tool fixture of claim 13 and an illumination tool.

19. In operative combination, illumination tool fixture of claim 13 and an illumination tool, said combination supported by an article of manufacture.

20. An interface apparatus for mounting a portable illumination tool, the apparatus comprising:

a. a tubular structure characterized by a lumen within which the portable illumination tool is receivable, said tubular structure having opposing first and second end portions, said first end portion adapted for fixation to an article of manufacture, said second end portion adapted to receive a clamp assembly, an interior segment of said second end portion of said tubular structure characterized by an interior diameter which progressively increases toward a free end of said second end portion of said tubular structure; and, b. a clamp assembly for selective advancement upon said second end portion of said tubular structure, said clamp assembly comprising a ring and a collet extending therefrom so as to define an annulus within which said free end of said second end portion of said tubular structure is received, said collet being progressively advanced upon a surface of said interior segment of said second end portion of said tubular structure via rotation of said ring upon said second end portion of said tubular structure in furtherance of establishing an interference fit for the portable illumination tool within said lumen of said tubular structure.

21. An illumination tool fixture comprising a sleeve and a clamping assembly, said sleeve comprising opposing free end portions, a first free end portion adapted to threadingly receive said clamping assembly such that progressive engagement of said clamping assembly upon said first free end portion establishes a wedged interference fit with an illumination tool within the fixture, said second free end portion adapted to anchor the fixture to an article of manufacture.

* * * * *